US005335423A

United States Patent [19]

McLaughlin

[11] Patent Number: 5,335,423

[45] Date of Patent: Aug. 9, 1994

[54] SIDING SPACER AND METHOD

[76] Inventor: Michael F. McLaughlin, 7 Beechnut Lane, Hudson, Mass. 01749

[21] Appl. No.: 941,656

[22] Filed: Sep. 8, 1992

[51] Int. Cl.[5] ..... G01D 21/00

[52] U.S. Cl. ..... 33/647; 33/646

[58] Field of Search ..... 33/646, 647, 648, 649

[56] References Cited

U.S. PATENT DOCUMENTS

| | | | |
|---|---|---|---|
| 116,256 | 6/1871 | Babcock | 33/647 |
| 172,292 | 1/1876 | Babcock | 33/646 |
| 198,772 | 1/1878 | Marsh | 33/646 |
| 221,732 | 11/1879 | Hobbs . | |
| 285,137 | 9/1883 | Kennedy . | |
| 298,682 | 5/1884 | Finch . | |
| 302,792 | 7/1884 | Stacey et al. . | |
| 316,338 | 4/1885 | Davis | 33/646 |
| 332,323 | 12/1885 | Brand | 33/646 |
| 377,178 | 1/1888 | Traut | 33/647 |
| 418,754 | 1/1890 | Schill . | |
| 434,777 | 8/1890 | Greene | 33/646 |
| 631,315 | 8/1899 | Meskill . | |
| 652,256 | 6/1900 | Farmer | 33/646 |
| 995,574 | 6/1911 | Sarlls . | |
| 1,031,854 | 7/1912 | Keyes . | |
| 1,115,202 | 10/1914 | Ingles . | |
| 1,598,986 | 9/1926 | Ping | 33/647 |
| 3,490,152 | 1/1970 | Printz . | |
| 4,110,911 | 9/1978 | Sucheck | 33/648 |
| 4,473,100 | 9/1984 | Wheeler . | |
| 4,936,021 | 6/1990 | Frenette et al. | 33/649 |

*Primary Examiner*—William A. Cuchlinski, Jr.
*Assistant Examiner*—Alvin Wirthlin
*Attorney, Agent, or Firm*—Damon J. Borrelli

[57] ABSTRACT

An apparatus and method for the attachment of siding to an architectural structure. The apparatus of the invention is characterized by a longitudinally extending gage member, a first element for engaging a first piece of siding, a second element for engaging a second piece of siding, and a handle element. In operation, the element for engaging the first piece of siding is adjusted using the gage member as a guide. Once adjusted as desired, the apparatus is placed in abutting contact with a first course of siding previously attached to an architectural structure. Next, a board making up a second course of siding is positioned in the element for engaging the second piece of siding. In the final step of the procedure, the board positioned in the element for engaging the second piece of siding is attached to the architectural structure.

9 Claims, 3 Drawing Sheets

SIDING SPACER AND METHOD

BACKGROUND OF THE INVENTION

1. Field of the Invention

The present invention relates to an apparatus for assisting in the attachment of lap siding to an architectural structure. More particularly, the invention is directed to an apparatus and method for the alignment of succeeding courses of clapboards.

2. Description of the Prior Art

A variety of lap siding spacing apparatuses are available in the prior art. Although efficient for some applications, these devices often must be mounted directly on the siding during use thus producing unwanted and undesirable cosmetic damage. Further, these devices typically are not configured to be easily carried in, for example, a carpenter's work belt during non-use.

Generally, to begin siding a first course of lap siding, e.g., clapboards or weatherboards, is affixed to the base of building. This first course is typically positioned such that it is level relative to the ground. Of course, design requirements may require that the boards be oriented at an acute or obtuse angle relative to level. Once the first course of boards is positioned, succeeding courses are attached such that their bases are separated by a given distance. The amount of separation between the base of each succeeding course is selected such that the boards will overlap each other. Mounting of each course is typically done by sight and, as a result, often produces an uneven separation between the courses. This technique may even produce additional variations within the courses. Attempts to correct this problem using mechanical devices have met with little or no success. Uneven separation within, or between, courses of boards can compromise architectural designs and result in disparate weathering of the entire siding system.

A need has arisen for an apparatus which permits the easy and quick mounting of siding while maintaining consistent separation between succeeding courses of, for example, clapboards or shingles.

SUMMARY OF THE INVENTION

It is an object of the present invention to provide a siding spacer which does not suffer from the foregoing disadvantages and limitations.

It is object of the present invention to provide a siding spacing apparatus that consistently separates succeeding courses of boards by a selected distance.

It is a further object of the present invention to provide a method of siding whereby successive courses of siding can be consistently mounted with a selected amount of overlap.

The apparatus of the present invention is characterized by a longitudinally extending gage member, an element for engaging a first piece of siding, an element for engaging a second piece of siding, and a handle element. As described in greater detail below, the handle element is secured the gage member and extends in a direction substantially parallel thereto.

The gage member has a first portion, a second portion, a first face surface, and a second face surface. A slot element extends from the first portion to the second portion. Juxtaposed to the slot element, and positioned on the first face surface, are indicia elements. These indicia elements are configured to indicate the distance between an edge of the element which engages the first piece of siding and an edge of that element which engages the second piece of siding. Preferably, the indicia elements are spaced so as to indicate inches or fractions thereof. The indicia elements can, however, indicate metric distances. The first face surface also preferably includes a series of indentations which are configured to substantially conform to the shape of a spine positioned on the element for engaging the first piece of siding.

The element that engages the first piece of siding affixed to the architectural structure is configured such that it is slidable on and along the slot element of the gage member. A locking element is provided to secure this element in a selected position relative to the gage member. The locking element generally includes a knob configured to be sufficiently tightenable that it secures the element that engages the first piece of siding in position. Typically, the knob includes a screw portion that can be removably and replaceably tightened into, and loosened from, the element that engages the first piece of siding. Finally, as noted above, the element that engages the first piece of siding preferably includes a spine. The spine cooperates with the locking element to secure the element that engages the first piece of siding in position. Accordingly, the spine is positioned on a surface that will be adjacent the first surface of the gage member when the apparatus of the invention is fully assembled.

The element that engages the second piece of siding is secured to the first portion of the gage member. In general, this element extends in a direction substantially perpendicular to the gage member. Preferably, this element has an L-shaped configuration with a first leg member perpendicular to a second leg member. The first leg member is sized and shaped to securingly engage a piece of siding being positioned for attachment to the architectural structure. Accordingly, when the apparatus is in use it pushes the second piece of siding toward the architectural structure. The second leg member is sized and shaped to supportingly engage the second piece of siding, i.e., it holds the second piece of siding up in position so that it can be affixed to the structure as desired.

The invention also contemplates a method of attaching siding to an architectural structure. The method of the invention utilizes the apparatus described above. To begin the method a first course of siding, e.g., clapboards or shingles, is affixed to the architectural support structure. This first course may be attached along a level line or at some angle relative to the level line depending on design requirements.

In the next step of the method of the invention, the position of the element for engaging the first piece of siding is adjusted using the gage member as a guide. More particularly, the position of this component is adjusted utilizing the indicia elements on the surface of the gage member in order to select a desired amount of board separation and, thus, overlap. Once adjusted as desired, the element for engaging the first course of siding is secured in position using the locking element of the apparatus of the invention. The apparatus of the invention is then placed in contact with the first course of siding. In particular, the element for engaging the first course of siding is placed in abutting relationship to at least one board of the first course of siding.

In the next step, a second course of siding is positioned on the architectural structure. In particular, a clapboard or shingle making up the second course of siding is positioned with its base in abutting and supporting relationship with the element for engaging the second piece of siding. The clapboard or shingle is thus held in position by the element for engaging a second piece of siding. Having positioned the clapboard or shingle as desired, it then is attached to the architectural structure. The procedure is repeated to secure other clapboards or shingles of the second course of siding.

Other general and specific objects of the invention will in part be obvious and will in part appear hereinafter.

The invention accordingly comprises the steps and apparatus embodying features of construction, combinations of elements and arrangements of parts adapted to effect such steps, as exemplified in the following detailed disclosure. The scope of the invention is indicated in the claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 1:
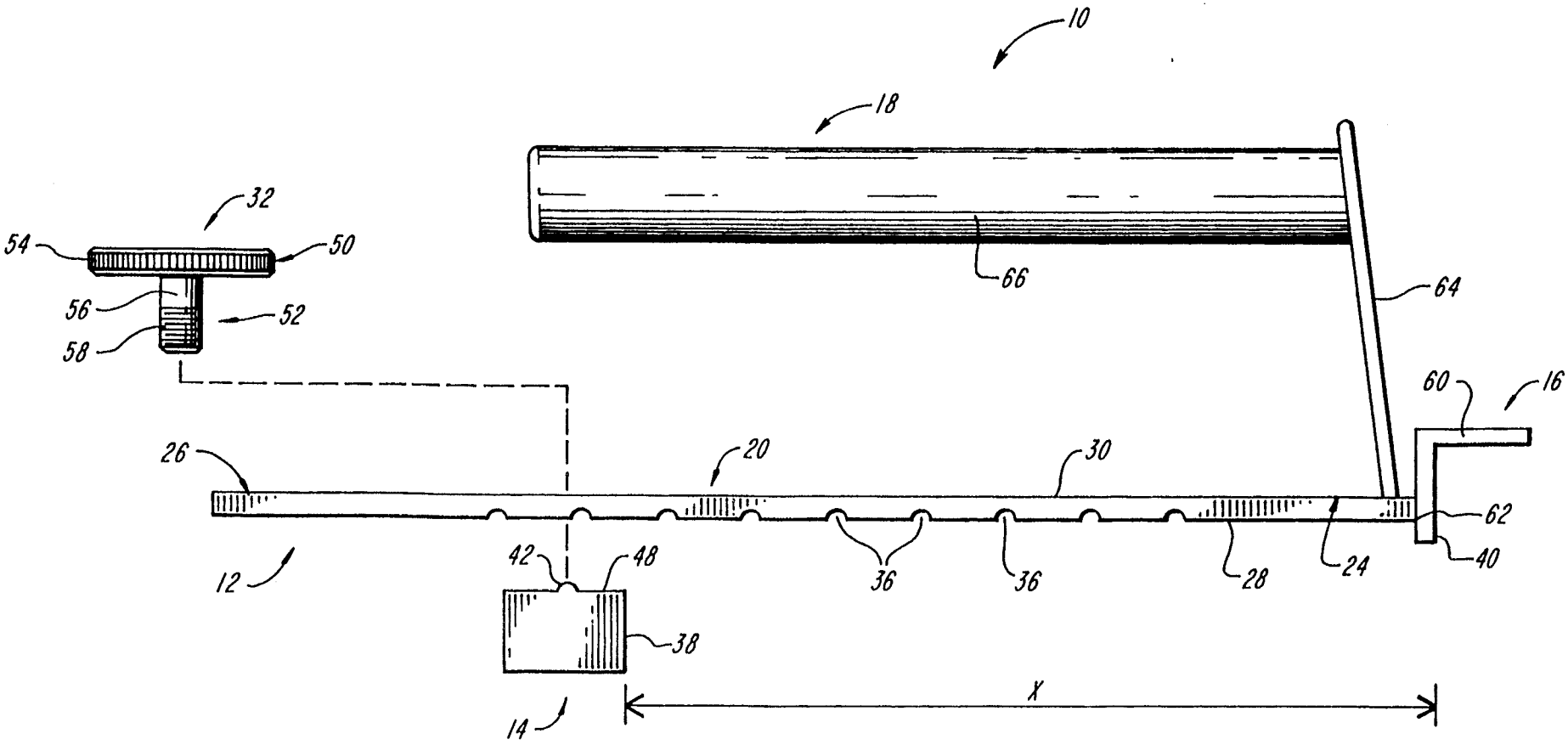
FIG. 1 is a side view of a siding spacer embodying the invention.
Figure 2:
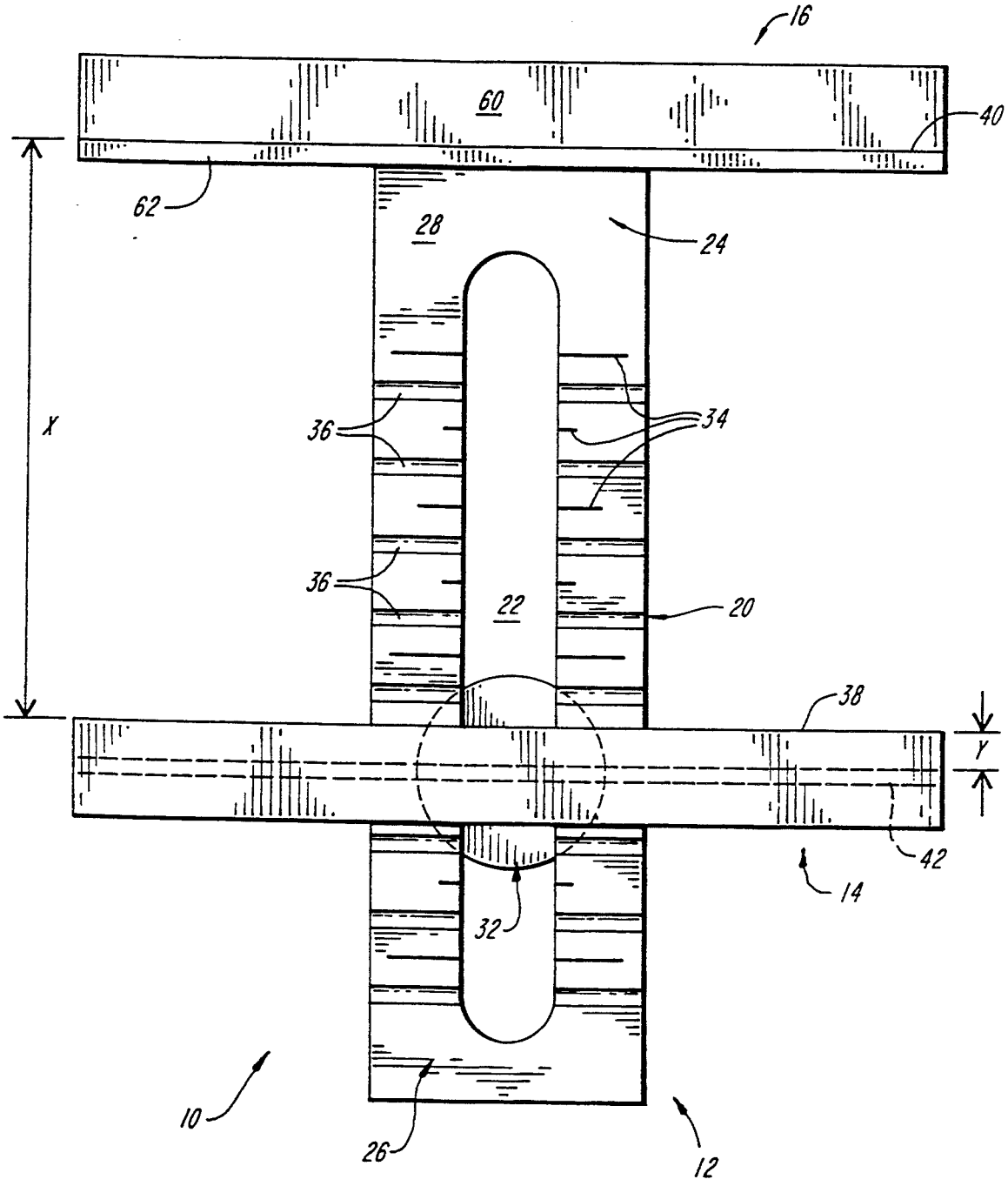
FIG. 2 is a bottom view of the siding spacer of FIG. 1.
Figure 3:
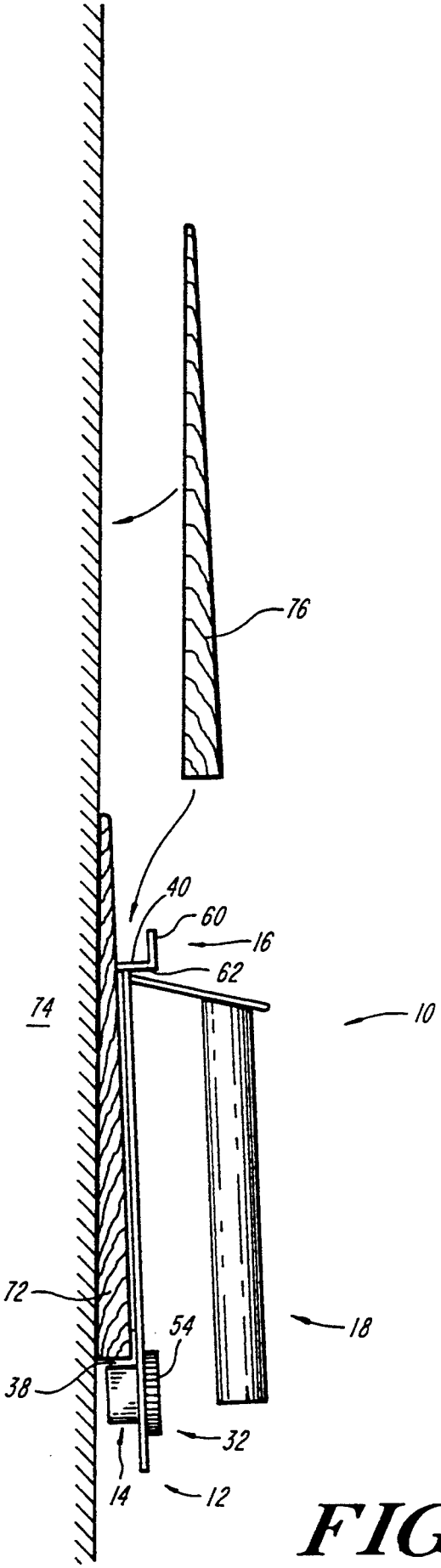
FIG. 3 is a side view of the siding spacer of FIGS. 1 and 2 depicting how the apparatus of the invention is utilized to guide the placement of boards making up succeeding courses of siding.

Referring to FIGS. 1 through 3, wherein like reference numerals refer to like parts, there is illustrated a siding spacer 10 including a longitudinally extending gage member 12, an element for engaging a first piece of siding 14, an element for engaging a second piece of siding 16, and a handle element 18.

As shown best in FIGS. 1 and 2, the gage member 12 is a rectangular member 20 having a slot element, i.e., aperture, 22. The rectangular member 20 includes a first portion 24 and a second portion 26. The rectangular member 20 also has a first face surface 28 and a second face surface 30. Surface 28 faces the shingles when the siding spacer 10 is in use. Positioned on the obverse of the rectangular member 20, surface 30 faces away from the siding when the siding spacer 10 is in use. The slot element 22 preferably extends longitudinally from the first portion 24 into the second portion 26. Preferably, the slot element 22 is positioned along the centerline of the rectangular member 20 and has a substantially oval configuration. The slot element 22 is sized and shaped so as to be capable of receiving the locking element 32 of the element that engages the first piece of siding 14. The gage member 12 can be constructed of virtually any strong, durable material, such as aluminum, stainless steel, or polymeric composites. Although the gage member 12 is typically between six and ten inches long and between two and three inches wide, those skilled-in-the-art will appreciate that the length and width of the gage member 12 can be selected as necessary for a given size of shingle, clapboard, or other siding material.

The first face surface 28 preferably includes indicia elements 34 and indentations 36. The indicia elements 34 are juxtaposed to the slot element 22. The elements 34 are configured such that they indicate the distance between an edge 38 of the element which engages the first piece of siding 14 and an edge 40 of that element which engages the second piece of siding 16. A exemplitive distance between the edges 38 and the edge 40 is denoted as "X" in FIGS. 1 and 2. In one embodiment of the invention, the indicia elements 34 are configured to indicate the distance "X" in whole inches or fractions thereof. In another embodiment of the invention, the indicia elements 34 are designed to indicate the distance "X" utilizing metric demarcations.

The indentations 36 are cut or pressed into the first face surface 28 and are in close proximity the indicia elements 34. The indentations 36 are configured to substantially conform to the shape of a spine 42, described below, positioned on the element for engaging the first piece of siding 14. So that the edge 38 can be positioned at a desired indicia element 34, the indentations 36 are offset relative the indicia elements 34 a distance equal that distance from the spine 42 to the edge 38 of the element 14. The amount of this offset is denoted as "Y" in FIG. 2. One indentation 36 is positioned for use in connection with each of the indicia elements 34. In operation, the indentations 36 and spine 42 cooperate to assist in securing the element for engaging the first piece of siding 14 at a selected position along the gage member 12.

The element that engages the first piece of siding 14 is configured such that it is slidable on and along the slot element 22 of the gage member 12. The element 14 includes a spine 42, a threaded aperture (not shown), and a locking element 32. Generally, the element 14 is a latitudinally extending substrate having a rectangular cross-sectional configuration. Those skilled-in-the-art will appreciate, however, that the element 14 can have virtually any cross-sectional configuration providing that edge 38 is oriented perpendicular relative to the first face surface 28 of the gage member 12. The spine 42 is integral with a surface 48 of the element 14. The surface 48 is adjacent the first face surface 28 of the gage member 12 when the invention is fully assembled. Typically, the spine 42 is a flange extending along the length of the surface 48. As noted above, the spine 42 cooperates with the indentations 36 to assist in securing the element 14 in position. The threaded aperture in element 14 is also positioned in surface 48 and is configured to receive the locking element 32 described below. Typically, the element 14 is sized such that it extends about one inch beyond each of the edges of the gage member 12. Accordingly, element 14 is generally between four and five inches long and approximately one-half of an inch on a side. It must be recognized, however, that the overall size of the element 14 can be altered as necessary for a given size of clapboard, shingle, or other siding material.

The locking element 32 cooperates with the indentations 36 and spine 42 to secure the element 14 in position. The locking element 32 also assists to guide the element 14 as it slides along the slot element 22 of the gage member 12. In the embodiment of the invention depicted in the FIGURES, the locking element 32 includes a knob element 50 having a shaft 52 integral with a disk-shaped end piece 54. The shaft 52 is sized and shaped to be removably and replaceably positionable into and out of the threaded aperture in surface 48 of element 14. Typically, the shaft 52 includes a non-threaded, shank portion 56 which slides within the slot element 22 of the gage member 12, and a threaded portion 58 which is designed to be positionable in the aperture of the element 14. The shaft 52 is of sufficient length that it can extend through the gage member 12 and be screwed into the aperture in surface 48 that amount necessary to bring a surface of the end piece 54 into frictional engagement with the second face surface 30 of the gage member 12. The disk-shaped end piece 54 can be of virtually any size and configuration providing it can be easily handled by the user of the siding spacer 10 and has sufficient mechanical strength to securely, frictionally engage the second surface 30 of the gage member 12. The element 14 and locking member 32 can be constructed of virtually any strong, durable material, such as aluminum, stainless steel, or polymeric composites.

The element that engages the second piece of siding 16 is secured to the first portion 24 of the gage member 12. In general, the element 16 extends in a direction substantially perpendicular to the gage member 12 and parallel to the element that engages the first piece of siding 14. Preferably, the element that engages the second piece of siding 16 has an L-shaped configuration. More particularly, the element 16 has a first leg member 60 that is perpendicular to a second leg member 62. The second leg member 62 is the portion of the element that engages the second piece of siding 16 that is attached to the gage member 12. Typically the leg member 62 is welded to the gage member 12, however, those skilled-in-the-art will appreciate that any methodology providing the requisite mechanical strength can be used. The first leg member 60 is sized and shaped to securingly engage a piece of siding being positioned for attachment to the architectural structure. In operation, the leg member 60 functions to push the second piece of siding toward the architectural structure so that it will be pressed firmly against the surface of the architectural structure. The second leg member 62 is sized and shaped to supportingly engage the second piece of siding, i.e., it holds the second piece of siding in position so that it can be affixed to the structure as desired. The legs 60 and 62 thus permit a user to both align and hold a piece of siding in position with only one hand; the user's other hand remains free to hold and operate a fastening mechanism, for example, a nail gun. The second leg member 62 has an edge 40 which, as discussed above, cooperates with the edge 38 of the element 14 to select the separation between the bases of succeeding courses of siding and, accordingly, the amount of overlap of the clapboards, shingles, or other siding material. The element 16 can be constructed of virtually any strong, durable material, such as aluminum, stainless steel, or polymeric composites. Typically, the element 16 is sized such that it extends about one inch beyond each of the edges of the gage member 12, accordingly, it is generally between four and five inches long. Each of the leg members 60 and 62 are typically about one-half of an inch in length. Those skilled-in-the-art, however, will appreciate that the dimensions of the element 16 can be selected as necessary for use in connection with a given size of clapboard, shingle, or other siding material.

In the embodiment of the invention shown in the FIG. 1 and 2, the handle element 18 is secured the first portion 24 of the gage member 12. This configuration permits the user to easily store the siding spacer 10 on, for example, a tool belt when not in use. It is recognized, however, that the handle element 18 can be connected at the opposing ends of both the first portion 24 and the second portion 26 if necessary. As depicted in FIGS. 1 and 2, the handle element 18 has a support 64. The support 64 is oriented such that it, and thus the entire handle element 18, extends in a direction away from the shingles when the siding spacer 10 is in use. Although the support 64 can be of virtually any configuration, it must be of sufficient size to provide clearance for the hand of a user when the siding spacer 10 is in use. More particularly, the support 64 must provide suitable clearance between the hand of a user, the gage member 12, and the locking element 32 when the siding spacer 10 is in use. Connected to support 64 is a hand grip 66. Preferably, the hand grip 66 extends in a direction substantially parallel to the gage member 12. In the preferred embodiment of the invention as depicted by the FIGURES, the hand grip 66 is a cylindrical member. Those skilled-in-the-art, however, will appreciate that the hand grip 66 can have any configured providing it can be easily grasped and manipulated during use.

Referring now to FIG. 3, the invention also contemplates a method of attaching siding, that is, clapboard or shingles, to an architectural structure. The method of the invention utilizes the siding spacer 10 described above.

To begin the method a first course of siding, e.g., clapboard, 72 is affixed to an architectural support structure 74. The clapboard 72 may be attached along a level line or at some angle relative to the level line depending on design requirements.

In the next step of the method of the invention, the position of the element for engaging the first piece of siding 14 is adjusted using the indicia elements 34 of the gage member 12 as a guide. More particularly, the element 14 is moved until it is positioned at that indicia element 34 on the surface 28 of the gage member 12 which provides the desired amount of clapboard separation and, thus, overlap. Once adjusted as desired, the element 14 is secured in position using the locking element 32. In particular, the end piece 54 of the locking element 32 is turned so as to tighten the threaded portion 58 of the shaft 52 into the aperture in the element 14. Tightening of the locking element 32 continues until a surface of the end piece 54 and the second face surface 30 of the gage member 12 are in frictional engagement.

As depicted in FIG. 3, in the next step of the procedure the siding spacer 10 is placed in contact with the clapboard 72 such that the edge 38 of the element 14 is in abutting relationship to clapboard 72. Having positioned the siding spacer 10, a clapboard 76 of the second course of siding can be placed in positioned in the element 16. In particular, the clapboard 76 is placed in the element 16 by moving it along the direction indicated by the arrows. Placement of the clapboard 76 on top of the leg structure 62 acts as a means for supporting the clapboard 76 during attachment. Concurrent with the support from leg 62, the leg 60 presses the clapboard 76 against the architectural structure 74.

To complete the procedure, the clapboard 76 is secured in position using, for example, a nail gun. Once secured, the siding spacer 10 can be moved a distance along the same clapboard 72 so as to further adjust the position of the clapboard 76. Alternatively, the siding spacer 10 can be moved along the clapboard 72 and the procedure re-commenced in order to attach another clapboard 76 of the second course.

By following the procedure of the invention successive layers of lap siding, e.g., clapboard and weatherboarding, shingles, or any other type of siding, can be attached to the architectural structure 74.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An apparatus for the application of siding to an architectural structure, said siding including at least first and second pieces of siding, said apparatus comprising:

a.) a longitudinally extending gage member having a first portion, a second portion, a first face surface and a second face surface, said gage member having a slot means extending from said first portion to said second portion, said first face surface having indicia means extending substantially continuously thereon, said indicia means being in juxtaposition to said slot means;

b.) a means for engaging said first piece of siding, said first piece of siding being affixed to said architectural structure, said means for engaging said first piece of siding being slidable on and along said slot means of said gage member and having a surface for supportingly receiving said first piece of siding, said means for engaging said first piece of siding being slidable on and along said slot means of said gage member such that said supporting surface is selectably positionable relative to said indicia means of said first face surface of said gage means, said supporting surface being in abutting relation to said indicia means of said gage member to indicate a selected distance, said means for engaging said first piece of siding having a locking means for securing said means for engaging said first piece of siding in a selected position relative to said gage member;

c.) a means for engaging said second piece of siding, said means for engaging said second piece of siding being secured to said first portion of said gage member and extending in a direction substantially perpendicular to said gage member; and d.) a handle means, said handle means having an end portion secured to said first portion of said gage member, said handle means extending in a direction substantially parallel to said gage member.

2. The apparatus of claim 1 wherein said indicia means are configured to indicate the distance between an edge of said means for engaging said second piece of siding and an edge of said means for engaging said first piece of siding.

3. The apparatus of claim 2 wherein said indicia means indicates the number of inches between said edge of said means for engaging said second piece of siding and said edge of said means for engaging said first piece of siding.

4. The apparatus of claim 2 wherein said indicia means are configured to indicate a metric measurement between said edge of said means for engaging said second piece of siding and said edge of said means for engaging said first piece of siding.

5. The apparatus of claim 1 wherein said means for engaging said first piece of siding includes a spine, said spine being positioned on a surface of said means for engaging said first piece of siding that is adjacent said first surface of said gage member when said means for engaging said first piece of siding is slidably positioned in said slot means of said gage member.

6. The apparatus of claim 5 wherein said first face surface includes a series of indentations, said indentations being configured to substantially conform to the shape of said spine on said means for engaging said first piece of siding.

7. The apparatus of claim 1 wherein said locking means includes a knob means for securing said means for engaging said first piece of siding in position relative to said gage member, said knob means being screwably removably and replaceably positioned in said means for engaging said first piece of siding.

8. The apparatus of claim 1 wherein said means for engaging said second piece of siding has an L-shaped configuration with a first leg member perpendicular to a second leg member, said first leg member being sized and shaped to securingly engage said second piece of siding, said second leg member being sized and shaped to supportingly engage said second piece of siding.

9. A method of attaching siding to an architectural structure, said method comprising the steps of:

a.) affixing a first piece of siding to said architectural structure;

b.) providing an apparatus having:

1.) a longitudinally extending gage member having a first portion, a second portion, a first face surface and a second face surface, said gage member having a slot means extending from said first portion to said second portion, said first face surface having indicia means extending substantially continuously thereon, said indicia means being in juxtaposition to said slot means;

2.) a means for engaging said first piece of siding affixed to said architectural structure, said means for engaging said first piece of siding being slidable on and along said slot means in said gage member and having a surface for supportingly receiving said first piece of siding, said means for engaging said first piece of siding being slidable on and along said slot means of said gage member such that said supporting surface is selectably positionable relative to said indicia means of said first face surface of said gage means, said supporting surface being in abutting relation to said indicia means of said gage member, said means for engaging said first piece of siding having a locking means for securing said means for engaging said first piece of siding in a selected position relative said gage member;

3.) a means for engaging a second piece of siding, said means for engaging said second piece of siding being secured to said first portion of said gage member and extending substantially perpendicular to said gage member; and 4.) a handle means, said handle means having an end portion secured to said first portion of said gage member, said handle means extending substantially parallel to said gage member;

c.) adjusting said means for engaging said first piece of siding along said slot means by positioning and securing said supporting surface in abutting relation to a selected indicia means, thereby establishing a predetermined distance between said supporting surface and said means for engaging a second piece of siding;

d.) placing said supporting surface in abutting relationship with said first piece of siding;

e.) placing said second piece of siding in abutting relationship with said means for engaging a second piece of siding;

f.) securing said second piece of siding to said architectural structure.

* * * * *